US007112269B2

(12) United States Patent
Slaugenhaupt et al.

(10) Patent No.: US 7,112,269 B2
(45) Date of Patent: Sep. 26, 2006

(54) MEASURING DUCT OFFGAS TEMPERATURES TO IMPROVE ELECTROLYTIC CELL ENERGY EFFICIENCY

(75) Inventors: Michael L. Slaugenhaupt, Apollo, PA (US); Jay N. Bruggeman, Harrison City, PA (US)

(73) Assignee: Alcoa, Inc., Pittsburg, PA (US)

( * ) Notice: Subject to any disclaimer, the term of this patent is extended or adjusted under 35 U.S.C. 154(b) by 497 days.

(21) Appl. No.: 10/645,070

(22) Filed: Aug. 21, 2003

(65) Prior Publication Data

US 2006/0037863 A1 Feb. 23, 2006

(51) Int. Cl.
*C25C 3/06* (2006.01)
*C25C 3/20* (2006.01)
*C25C 7/06* (2006.01)

(52) U.S. Cl. ..... 205/336; 205/391; 205/392; 205/396

(58) Field of Classification Search ..... 205/336, 205/391, 392, 396
See application file for complete search history.

(56) References Cited

U.S. PATENT DOCUMENTS

| | | | | |
|---|---|---|---|---|
| 3,977,950 A | | 8/1976 | Tortil | 204/67 |
| 4,210,513 A | | 7/1980 | Mutschler et al. | 204/225 |
| 4,518,475 A | | 5/1985 | Sivilotti | 204/247 |
| 4,668,350 A | | 5/1987 | Desclaux et al. | 204/67 |
| 4,668,352 A | * | 5/1987 | Duprat et al. | 205/336 |
| 5,288,383 A | | 2/1994 | Sparwald et al. | 204/225 |
| 5,456,808 A | * | 10/1995 | Juric | 205/380 |
| 6,132,571 A | | 10/2000 | Bell | 204/243.1 |
| 6,220,748 B1 | | 4/2001 | Bates | 374/10 |
| 6,440,294 B1 | | 8/2002 | Cotten | 205/367 |
| 2005/0040047 A1 | | 2/2005 | Bruggeman et al. | |

FOREIGN PATENT DOCUMENTS

| | | |
|---|---|---|
| CA | 996056 A | 8/1976 |
| EP | 0 195 142 | 9/1986 |
| FR | 2029493 A | 10/1970 |

OTHER PUBLICATIONS

Effect of Open Holes in the Crust on Gasueous Flouride Evolution From Pots (The Minerals, Metals, & Materials Society) Slaugenhaupt, Bruggeman, Tarcy and Dando (6 pages) San Diego Conf. Mar. 2-6, 2003.

* cited by examiner

*Primary Examiner*—Roy King
*Assistant Examiner*—William T. Leader

(57) ABSTRACT

Operations in a cell for electrolytic production of aluminum are controlled by establishing a standard rate of addition of aluminum fluoride to a molten electrolyte covered by a crust; establishing a target temperature for a duct carrying offgas from a chamber containing the molten electrolyte; measuring an actual temperature in the duct; and, in response to the actual temperature measurement in the duct, performing at least one of (1) when the actual temperature is greater than the target temperature, inspecting the crust for a crust hole and then repairing any observed crust hole, and (2) varying an actual rate of addition of aluminum fluoride to the electrolyte by increasing the actual rate above the standard rate when the actual temperature is greater than the target temperature and by reducing the actual rate below the standard rate when the actual temperature is less than the target temperature. Controlling operations in accordance with the invention improves cell energy efficiency.

8 Claims, 1 Drawing Sheet

MEASURING DUCT OFFGAS TEMPERATURES TO IMPROVE ELECTROLYTIC CELL ENERGY EFFICIENCY

FIELD OF THE INVENTION

The present invention relates to controlling operations of aluminum production cells in order to improve energy efficiency and to reduce fluoride emissions.

BACKGROUND OF THE INVENTION

Production of aluminum by the Hall-Heroult process makes use of a cell having a chamber containing alumina dissolved in a molten cryolite electrolyte bath. It is standard practice to add aluminum fluoride regularly to the cryolite so that the $NaF/AlF_3$ mass ratio is maintained at about 0.80–1.20.

The cryolite bath is covered by a solid crust that is punctured regularly when molten aluminum is tapped from the cell. Increasing the area of the open crust holes results in more fluoride evolution from the smelting pot, thereby increasing load on the pot scrubber and the resulting smelter fluoride emission level.

Increasing the average area of open crust holes in a pot line also increases variations in the bath ratio, resulting in poorer cell performance. This occurs because the amount of fluoride evolved from individual pots fluctuates while each pot continues to receive a relatively constant supply of fluoride in reacted ore from the dry scrubber line, plus the same daily maintenance supply of aluminum fluoride. These factors make it desirable to quantify the effects of pot operating practices on fluoride evolution in order to prioritize various efforts to minimize fluoride evolution.

In the prior art some attempts have been made to control aluminum fluoride additions to smelting cells. However, the prior art attempts each suffer from one or more serious disadvantages making them less than entirely suitable for their intended purpose.

Desclaux et al. U.S. Pat. No. 4,668,350 issued May 26, 1987 represents an effort in the prior art to control the rate of addition of aluminum fluoride to a cryolite-based electrolyte in an aluminum production cell. The claimed method requires regular measurements of cell temperature, either directly or by means such as a thermocouple inserted in the side wall, or the floor, or in a cathode current collector in the cell floor.

A principal objective of the present invention is to provide a process for controlling additions of aluminum fluoride to individual aluminum electrolysis cells, thereby to improve energy efficiency.

A related objective of the invention is to provide a process for controlling inspections and repairs for crust holes in aluminum production cells so that such inspections and repairs are performed where and as needed.

A further objection of our invention is to reduce fluoride emissions from aluminum production cells having cryolite-based molten electrolytes.

Additional objectives and advantages of our invention will become apparent to persons skilled in the art from the following detailed description of some particularly preferred embodiments.

SUMMARY OF THE INVENTION

In accordance with the present invention there is provided an electrolytic cell wherein aluminum is produced by electrolysis of alumina dissolved in a molten salt bath. A preferred cell comprises a pot defining a chamber containing the molten electrolyte, a cathode, at least one anode contacting the electrolyte, and a solid crust above the electrolyte. The crust comprises solidified electrolyte and alumina, and may build up to a thickness of several inches.

The molten electrolyte comprises sodium fluoride and aluminum fluoride in a weight ratio of about 0.7–1.2, together with lesser amounts of magnesium fluoride and calcium fluoride. The molten electrolyte has a temperature of at least about 900° C., more preferably about 900–1050° C. The electrolyte is preferably maintained at a temperature of about 960–980° C. As reduction proceeds, a pad of molten aluminum settles on the cell bottom above the cathode.

In order to tap molten aluminum from the cell the crust is broken periodically, leaving a hole through which heat is lost from the electrolyte and fluorides are evolved into the chamber. Cell voltage is increased to compensate for the lost heat, thereby increasing power consumption. The solid crust must also be broken away to replace spent anodes.

Heat loss from the cell is reduced by repairing the crust holes. Crust hole repair may be effected by covering the holes with a loose mass of solid particles or by covering the holes with solid particles contained in a receptacle as described in Cotten U.S. Pat. No. 6,400,294, the disclosure of which is incorporated by reference. Solid particles suitable for crust repair include alumina, aluminum fluoride, cryolite, and mixtures thereof in varying proportions.

Pot lines of electrolytic cells for aluminum production are also provided with ducts for carrying away fumes evolved by the cells. The evolved fumes contain aluminum fluoride, hydrogen fluoride, alumina, water, and dust. In order to reduce fluoride emissions, the fumes are scrubbed in solid vessels containing smelting grade alumina that is later fed to the cells.

In accordance with our invention we determine a standard rate of addition of aluminum fluoride to each cell in a pot line, by measuring approximately the average aluminum fluoride requirement over a period of time. The standard rate of addition of aluminum fluoride may vary from time to time.

A target temperature is also established in a duct carrying offgas away from the cell chamber. The target temperature is preferably an ideal temperature as measured by means of a thermocouple located inside an offgas duct for each cell, and may vary from time to time. We also measure actual temperatures in each offgas duct periodically, by means of a thermocouple located inside the duct.

When the actual temperature in the offgas duct is greater than the target temperature, we inspect the crust for crust holes and when a crust hole is observed, it is repaired. In addition, the actual rate of addition of aluminum fluoride is increased above the standard rate. When the actual temperature is less than the target temperature, the actual rate of aluminum fluoride addition to the cell is reduced below the standard rate. The steps of measuring actual offgas temperature, inspecting and repairing the crust, and varying the actual rate of aluminum fluoride addition either above or below the standard rate are repeated as often as necessary. When the measured offgas temperature is about equal to the target temperature, the rate of aluminum fluoride addition is unchanged. We have discovered that maintaining pot heat balance in accordance with the invention minimizes energy requirements for operating an aluminum electrolysis cell.

DETAILED DESCRIPTION OF PREFERRED EMBODIMENTS

Figure 1:
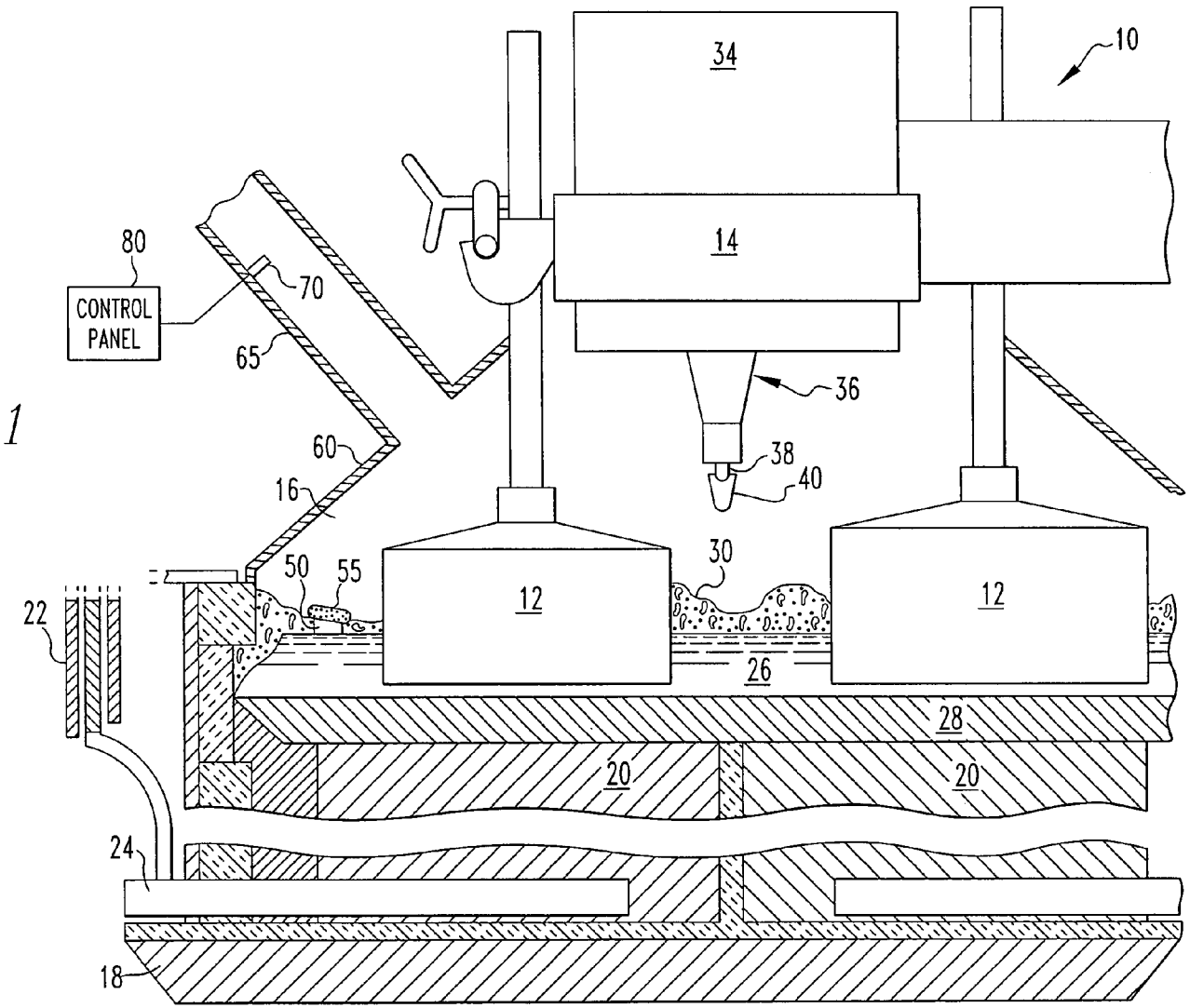
FIG. 1 is a cross-sectional view of an electrolytic cell for producing aluminum in accordance with the invention.

In FIG. 1 there is shown an electrolytic cell 10 for aluminum production, including carbon anodes 12 suspended by anode rods 13 from a bridge 14. The anodes 12 are situated within a cell chamber 16 lined with a layer of insulating material 18 upon which solid carbon cathode blocks 20 are positioned. The cathode blocks 20 are connected in an electrical circuit with an external bus 22 via steel collector bars 24 passing through the cathode blocks 20.

A molten cryolite electrolyte 26 containing dissolved alumina is maintained at approximately 950–960° C. within the chamber 16. As electrolytic reduction proceeds, a pad 28 of molten aluminum covers the cathode blocks 20. A layer of solid crust 30 forms above the molten electrolyte 26 surrounding the carbon anodes 12. The crust 30 is generally several inches thick.

The movable bridge 14 is adjustable vertically to enable the carbon anodes 12 to be elevated or lowered relative to the molten bath 26. An overhead hopper 34 supported above the anodes 12 is filled with alumina. Alumina from the hopper 34 is periodically added to the bath 26 as needed, through a feeder mechanism 36 including a steel rod 38 supporting a ceramic plugger foot 40. When alumina is added to the bath 26, the steel rod 38 and plugger foot 40 are thrust downwardly to punch a hole in the crust 30. An overhead conveyor 42 supplies alumina ore to the hopper 34 as needed.

Tapping molten aluminum from the metal pad 28 requires breaking the crust 30 to insert a vacuum tap (not shown). In a typical Hall-Heroult electrolytic cell, molten aluminum is tapped approximately every 24 hours. After the tap is removed a hole 50 remains in the crust 30 above the molten electrolyte 26. Holes left over from molten metal tapping typically have dimensions of about 12 in.×12 in. (30 cm.×30 cm.).

Holes 50 in the crust 30 may be repaired by covering the holes with masses of solid particles comprising alumina, crushed cryolite, or mixtures thereof. Alternatively, a hole 50 may be repaired by covering with a paper bag 55 filled with solid particles in accordance with the method disclosed in Cotten U.S. Pat. No. 6,440,294, the disclosure of which is incorporated by reference to the extent consistent with the present invention. The paper bag 55 is preferably double walled and is filled with approximately 20 lb. (9.1 kg.) of a mixture of smelting grade alumina (SGA) and crushed cryolite. A mixture of 10 lb. SGA and 10 lb. crushed cryolite is quite suitable.

Alumina and cryolite particles in the bag 55 are sintered into a porous mass by heat from the molten bath 26. The crust 30 is eventually restored to an unbroken, unitary mass.

Fumes escaping from holes 50 in the crust 30 are confined by a metal hood 60. The fumes, containing HF and various particulates, are channeled to an exhaust duct 65 containing a thermocouple 70 for measuring temperature of gases in the duct 65. Temperature measurements from the thermocouple 70 are sent to a central control panel 80 where temperature measurements from several cells 10 are monitored.

Cells exhibiting an actual exhaust duct temperature deviating from a target temperature are inspected for crust holes. If a crust hole is observed, the hole is repaired to reduce heat losses and escaping fumes. In addition, when the actual exhaust duct temperature is too high, the actual rate of addition of sodium fluoride to the cell 10 is generally increased to an actual rate above the standard rate of addition. Accordingly, fluorides lost in vapors escaping through open holes 50 are replenished so that bath ratio deviations are limited. When the actual exhaust duct temperature is less than a target temperature, the actual rate of addition of sodium fluoride to the bath 26 is lowered below the standard rate so that the sodium fluoride-aluminum fluoride bath ratio is maintained within desired limits.

Having described the presently preferred embodiments, it is to be understood that the invention may be otherwise embodied within the scope of the appended claims.

What is claimed is:

1. A process for controlling operations in a cell for producing aluminum by electrolysis of alumina wherein said cell comprises a chamber containing a molten electrolyte comprising cryolite and alumina, said electrolyte being at least partially covered by a solid crust, said process comprising a) establishing a standard rate of addition of aluminum fluoride to said electrolyte, b) establishing a target temperature for a duct carrying offgas from said chamber, c) measuring an actual temperature in said duct, and d) in response to the actual temperature measured in step (c), performing at least one of:

1) when the actual temperature is greater than the target temperature, inspecting said crust for a crust hole and when a crust hole is observed repairing it, and 2) varying an actual rate of addition of aluminum fluoride to said electrolyte in response to the actual temperature measured in step (c), by increasing said actual rate of aluminum fluoride addition above the standard rate when the actual temperature is greater than the target temperature and by reducing said actual rate below the standard rate when the actual temperature is less than the target temperature.

2. The process of claim 1 further comprising e) repeating steps (c) and (d).

3. The process of claim 1 wherein step (d)(2) comprises adding aluminum fluoride to said electrolyte at about the standard rate when said actual temperature is about equal to the target temperature.

4. The process of claim 1 comprising performing step (d)(1) when the actual temperature is greater than the target temperature by more than a preselected limit.

5. The process of claim 1 comprising performing step (d)(2) when the actual temperature deviates from the target temperature by more than a preselected limit.

6. The process of claim 1 further comprising passing a electric current through said electrolyte, thereby to produce aluminum in said cell.

7. A process for controlling operations in a plurality of electrolytic cells as described in claim 1, comprising f) performing steps (a), (b), and (c) in each said cells, g) transmitting an actual temperature measured in step (c) from each said cells to a control panel displaying said actual temperature of each said cells, and h) performing step (d) on any of said cells in which said actual temperature deviates from said target temperature by more than a preselected limit.

8. The process of claim 7 further comprising passing an electric current between an anode and a cathode in each said cells, thereby to produce aluminum in each said cells.

* * * * *

UNITED STATES PATENT AND TRADEMARK OFFICE
Certificate

Patent No. 7,112,269 B2 Patented: September 26, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michael L. Slaugenhaupt, Apollo, PA (US); Gary Tarcy, Murrysville, PA (US); and Neal Dando, Murrysville, PA (US).

Signed and Sealed this Nineteenth Day of July 2011.

ALEXA D. NECKEL
*Supervisory Patent Examiner*
Art Unit 1723
Tecnology Center 1700